US007062872B2

(12) United States Patent
Williams et al.

(10) Patent No.: US 7,062,872 B2
(45) Date of Patent: Jun. 20, 2006

(54) LIGHTWEIGHT COLLAPSIBLE SIGNALING DEVICE

(76) Inventors: Jeffrey A. Williams, 4439 Highland, Downers Grove, IL (US) 60515; Grant D. Dicke, 4524 Seeley, Downers Grove, IL (US) 60515

( * ) Notice: Subject to any disclaimer, the term of this patent is extended or adjusted under 35 U.S.C. 154(b) by 0 days.

(21) Appl. No.: 10/763,509

(22) Filed: Jan. 23, 2004

(65) Prior Publication Data

US 2005/0160645 A1 Jul. 28, 2005

(51) Int. Cl.
*G09F 15/00* (2006.01)
*G09F 7/00* (2006.01)
*G09F 21/02* (2006.01)

(52) U.S. Cl. ..... 40/586; 40/610; 40/612; 40/607.04; 160/377

(58) Field of Classification Search ..... 40/586, 40/610, 607.04, 611.11, 612; 160/377, 378, 160/132, 84.1 F; 133/907, 26.1, 902, 20.1; D3/2, 3, 5, 6; D12/419, 191
See application file for complete search history.

(56) References Cited

U.S. PATENT DOCUMENTS 403,698 A * 5/1889 Rector ..... 40/586
3,388,712 A * 6/1968 Taylor ..... 135/98
3,922,998 A * 12/1975 May ..... 116/40
5,551,177 A 9/1996 Cowgill et al.
5,598,654 A 2/1997 Cowgill et al.
5,694,711 A 12/1997 Cowgill et al.
5,729,926 A 3/1998 Cowgill et al.
6,003,256 A 12/1999 Leach et al.
2002/0104242 A1* 8/2002 Haugen ..... 40/606

* cited by examiner

*Primary Examiner*—Cassandra Davis
(74) *Attorney, Agent, or Firm*—Olson & Hierl, Ltd.

(57) ABSTRACT

A collapsible signaling device bearing a pair of opposed message panels is convertible between a display configuration and a compact linear storage configuration. The message panels are joined together at spaced apart points along their periphery using spacers to form a pocket having an internal cavity. A mast is insertable within the pocket and is joined to the panel members at its upper end. A pair of struts of spring material are joined at one end to the upper end of the mast and are joined at their lower ends to a slider member which is slidably movable with respect to the mast. As the slider member is advanced toward the upper end of the mast, the struts are outwardly bowed imparting outwardly directed tension to the periphery of the message panels.

27 Claims, 14 Drawing Sheets

LIGHTWEIGHT COLLAPSIBLE SIGNALING DEVICE

BACKGROUND OF THE INVENTION

1. Field of the Invention

The present invention pertains to signs bearing a pair of opposed message panels and in particular to such signs which can be collapsed and roll up for compact linear storage.

2. Description of the Related Art

Safety warning signs play an important role in protecting school children at crossing sites as well as construction workers at road side and other construction locations. Temporary signs may mounted for free standing operation or may be hand held. One important type of sign includes a pair of opposed message panels typically bearing the legends "STOP" and "SLOW". A worker or crossing guard standing alongside a mounted sign can rotate the sign as desired to display the appropriate message. Similarly, hand held signs can be rotated to display the appropriate message to oncoming motorists.

Because of their temporary nature, these types of signs are usually carried with other equipment in an automobile or other vehicle, and are extracted as needed. Functionally, the signs could be constructed with rigid message panels and this will provide oncoming motorists and others with the desired safety warning. However, many users prefer the sign to take on a linear or elongated storage configuration, rather than a flat panel configuration. Examples of roll up signs are found in commonly assigned U.S. Pat. No. 6,003,256 as well as U.S. Pat. Nos. 5,694,711; 5,729,926; 5,551,177; and 5,598,654. In general, the signs described in these patents are provided with a number of different styles of panel-supporting framework which is collapsible or otherwise configurable to assume a compact storage configuration. However, there is a continued desired for sign systems which are readily configurable between storage and display positions. It has also been found desirable to provide such sign systems with the ability to assume a linear or elongated storage configuration.

SUMMARY OF THE INVENTION

The present invention provides improvements over the prior art by providing an inexpensive collapsible sign system that can be quickly converted between storage and display configurations. Sign systems according to principles of the present invention are preferably joined together to form a unitary assembly, although variations in which the assemblies are broken into two or more components can be provided.

There is an object of the present invention to provide collapsible, opposed message panel sign systems which are lightweight and which can be readily configured into a linear or elongated semi-cylindrical storage configuration.

A further object of the present invention is to provide such sign panel systems with improved internal tensioning for opposed message panels of fabric or other flexible configuration. It is also an object of the present invention to provide sign panel systems in which flexible message panels having a reflective coating are maintained in a taut planer display configuration, substantially free of waves or wrinkles which might produce an unintended dazzle effect in nighttime conditions once objected to focused, point sources of light.

These and other objects, according to principles of the present invention, are provided in a collapsible signaling device, including a pair of opposed message panels joined at their marginal edges to form a pocket member. The panels are joined together utilizing spacers so as to form an internal volume within the pocket member. A mast is inserted within the pocket member and is secured to the pocket member at its upper end. A pair of struts or bands of spring material extend along the mast and are joined at one end to the upper portion of the mast. A slider member slidably movable with respect to the mast is joined to the remaining ends of the struts. When the slider member is inserted increasing amounts within the mast, the struts mast and slider member cooperate to cause the struts to bow outwardly and to contact at least some of the spacers thus applying outwardly directed tension to a series of points about the outer periphery of the sign panels. This maintains the sign panels in a taut, planer configuration. A lock member holds the slider in desired position relative to the mast, maintaining the sign panels in a display configuration. To store the signaling device, the lock member is released allowing withdrawal of the slider from the mast. Upon sufficient withdrawal, tension on the struts is released allowing the struts to lie alongside the mast. The message panels can then be rolled about the mast to form a linear or elongated, substantially cylindrical, storage configuration. In one embodiment, the slider member comprises a tube telescopically insertable within a tubular mast. In a second embodiment, the slider member comprises a collar slidably movable along the mast.

DETAILED DESCRIPTION OF THE PREFERRED EMBODIMENTS

Turning now to the drawings and initially to FIGS. 1–10, a first embodiment of a collapsible signaling device according to principles of the present invention is generally indicated at 10. As will be seen herein, signaling device 10 is readily configurable between a fully opened display configuration illustrated in FIG. 1 and a storage configuration illustrated in FIG. 2. Signaling device 10 includes a pair of opposed message panels 12, 14 which preferably have the same shape and size and are arranged in a registered, overlying relationship. If desired, the message panels could be made of rigid or semi-rigid material. However, further advantages made possible by the present invention are attained in signaling device arrangements in which the message panels are flexible, such as message panels of fabric and especially reflective, coated fabric compositions.

Figure 4:
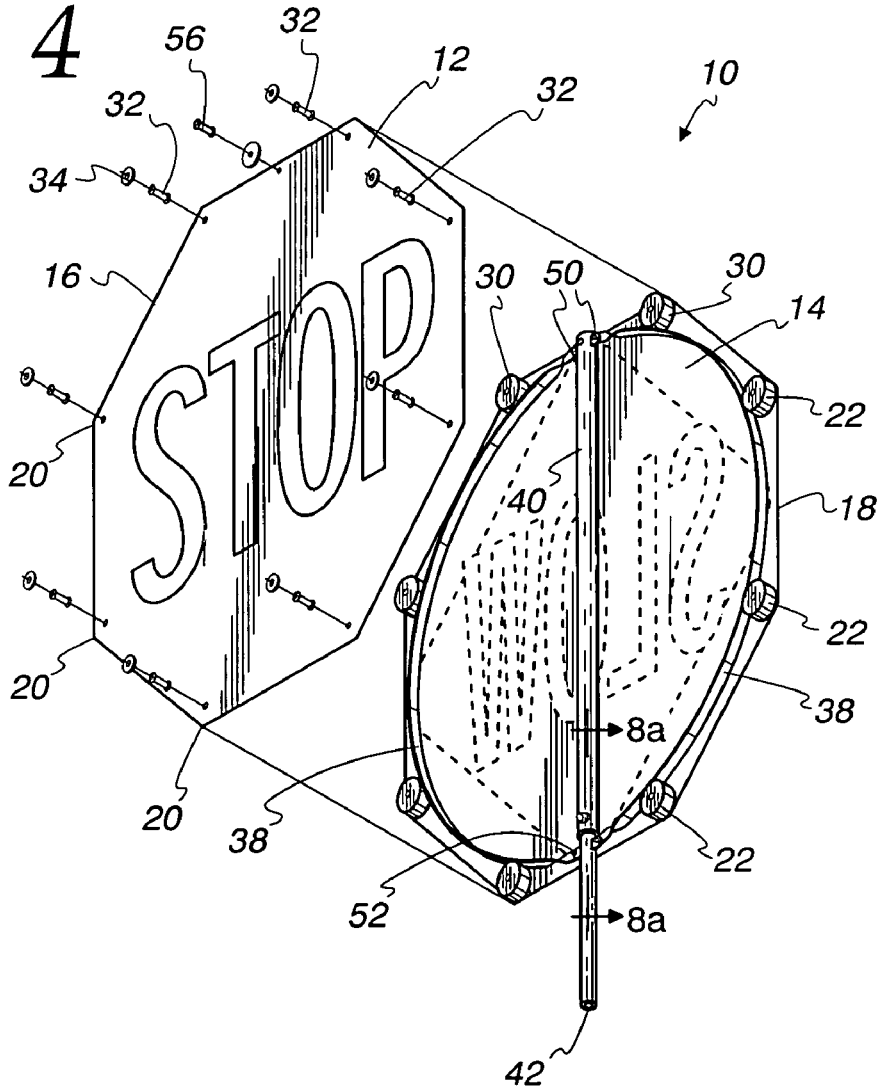
FIG. 4 shows the internal structure of the signaling device in a fully opened configuration.
Figure 7:
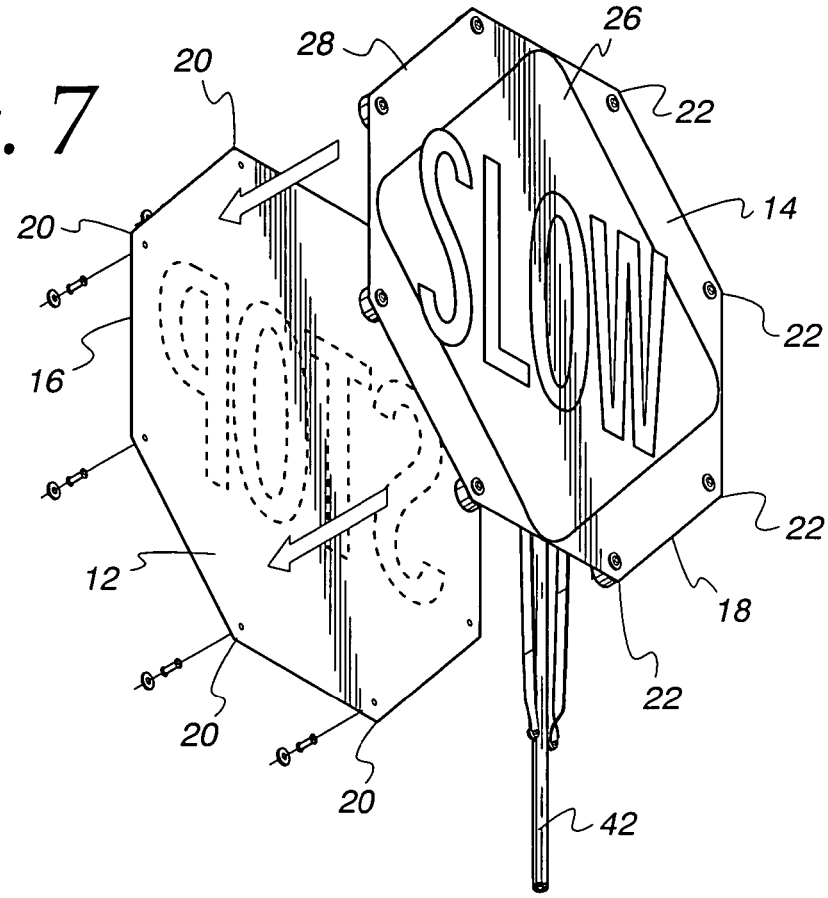
FIG. 7 is a rear elevational view of the signaling device in a fully closed, unwrapped configuration.

As can be seen by comparing FIGS. 4 and 7, the opposed message panels bear different indicia. In the illustrated embodiment, message panel 12 displays the safety message "STOP" while message panel 14 displays the safety message "SLOW." As mentioned, the message panels have the same shape and size. In the preferred embodiment, the message panels 12, 14 have an octagonal margin or outer edge 16, 18 with corners 20, 22, respectively. Referring to FIG. 4, message panel 12 bears the legend "STOP" and accordingly the octagonal field of the display surface of the message panel is appropriately octagonal in shape. As is customary, the background color of message panel 12 is red and the message lettering is white. Referring to FIG. 7, the message panel 14 bears the legend "SLOW" which is conventionally displayed on a diamond-shaped field. Accordingly, message panel 14 includes a message field 26 which has a diamond shape and which is safety yellow in color, with lettering in black. The outer portion 28 lying between message field 26 and outer edge 18 is made non-conspicuous so as to avoid confusing the general indication of a warning message provided by the diamond-shaped message field 26. In the preferred embodiment, outer area 28 has a black color, although sky gray, sky blue or other colors are possible.

As indicated above, the opposed message panels 12, 14 have the same shape and size, although the present invention contemplates other arrangements. For example, the message panels could have different shapes or sizes if desired. Further, the message panels need not contain a text message, a color-keyed message background, or a shape-keyed message field.

Figure 1:
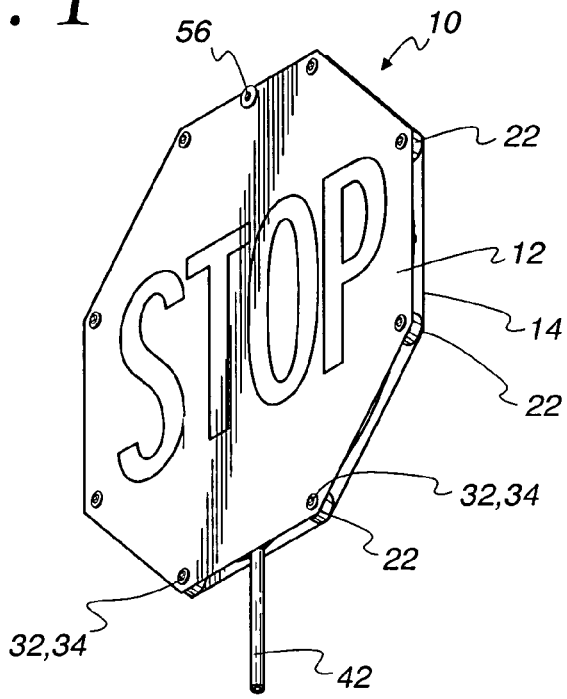
FIG. 1 shows a first embodiment of a signaling device in a fully opened display configuration.
Figure 2:
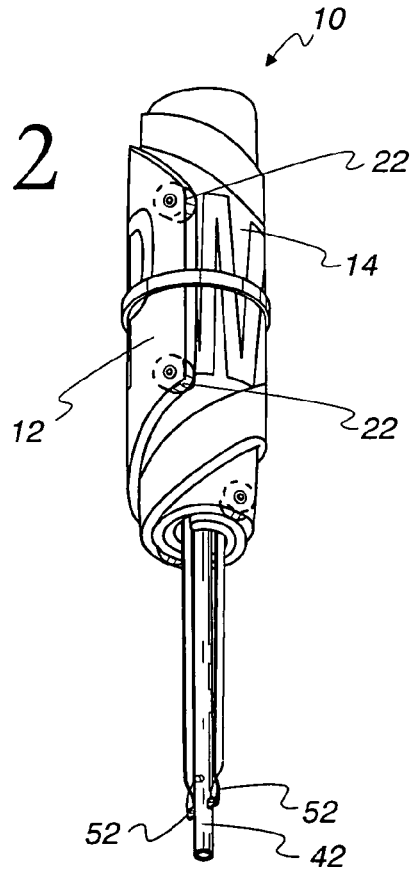
FIG. 2 shows the display device in a fully closed and wrapped storage configuration.
Figure 3:
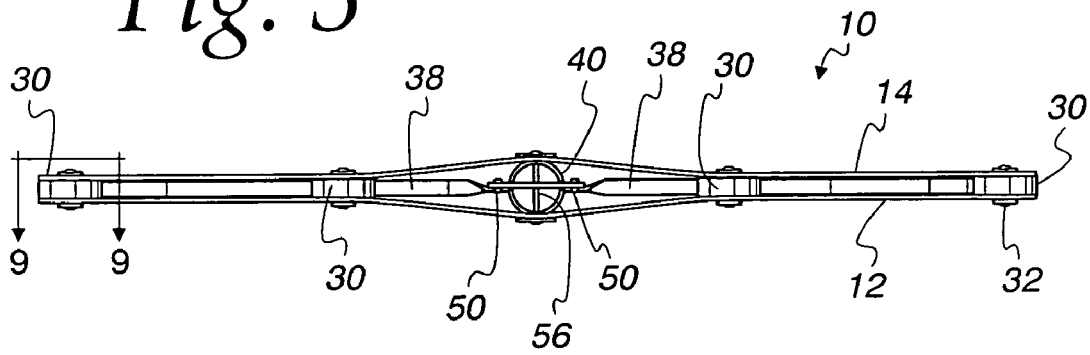
FIG. 3 is a top plan view of the signaling device of FIG. 1.
Figure 9:
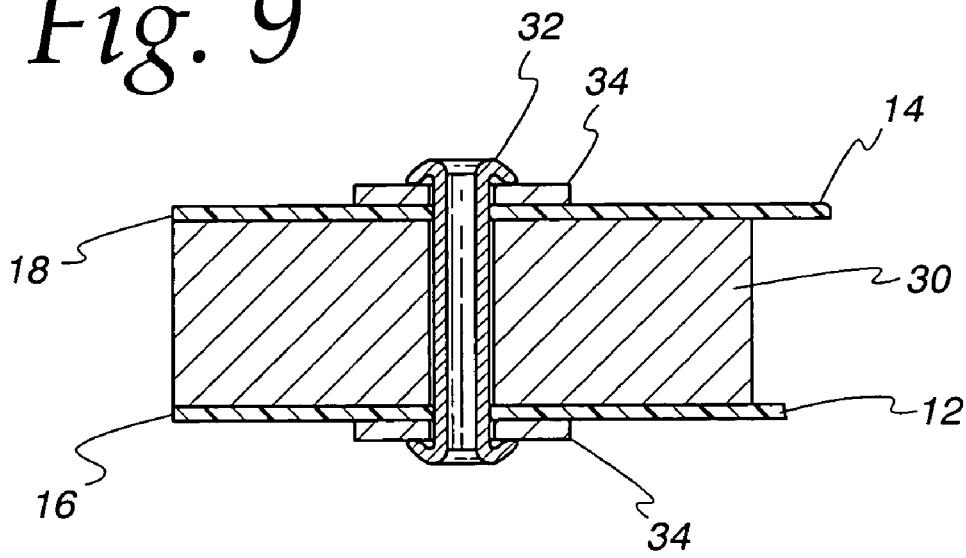
FIG. 9 is a fragmentary cross-sectional view taken along the line 9–9 of FIG. 3.

With continued reference to FIGS. 1–7, and in particular to FIG. 4, the message panels 12, 14 are joined together at their corners 20, 22 using spacers 30 and rivet fasteners 32 which extend through the message panels 12, 14 and the intervening spacers 30 in the manner indicated in FIGS. 3 and 9. As indicated in FIG. 9, rivets 32 are preferably of hollow construction and back up washers 34 are provided at each rivet head. In the preferred embodiment, spacers 30 have a cylindrical shape although other shapes may be employed, if desired. The circular shape of spacers 30 is preferred for their cooperation with spring bands 38, shown for example in FIG. 4.

Figure 5:
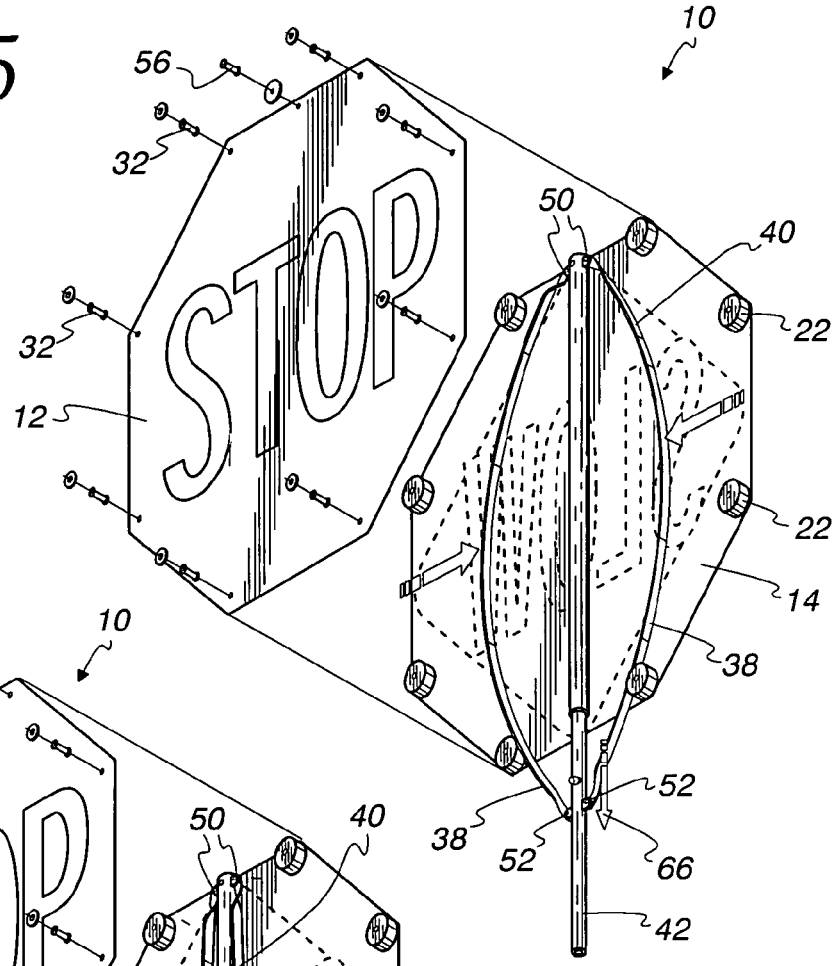
FIG. 5 shows the internal structure of the signaling device in an intermediate, partially open configuration.
Figure 6:
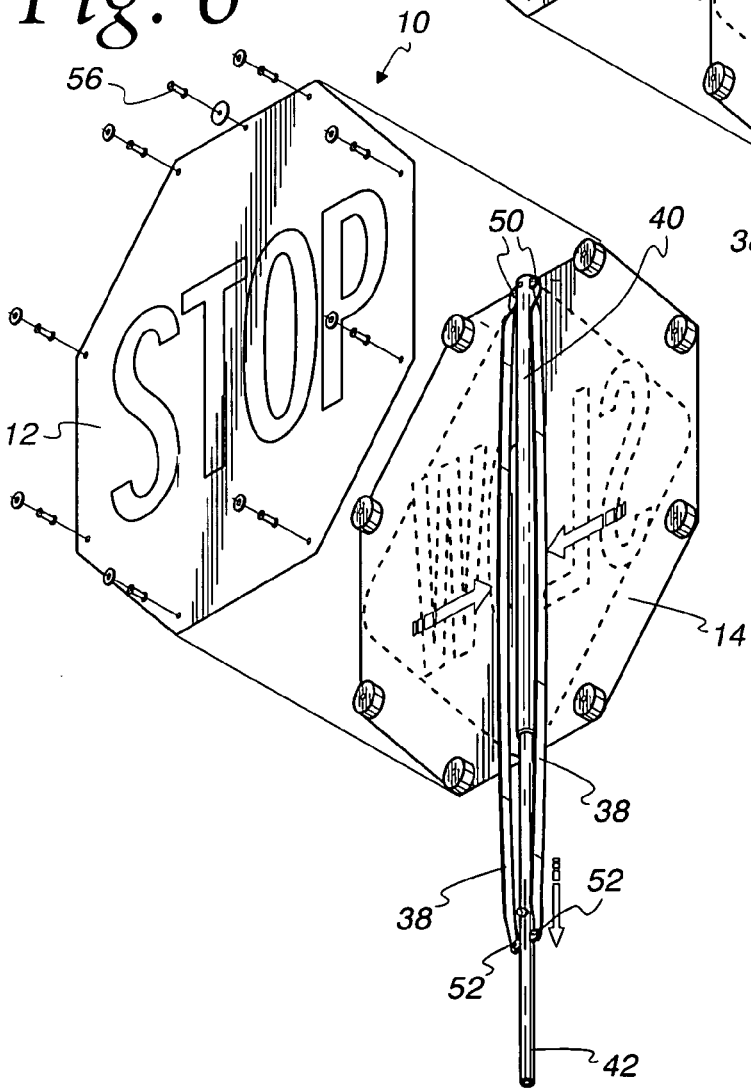
FIG. 6 shows the internal structure of the signaling device in a fully closed configuration.

Turning now to FIGS. 4–6, signaling device 10 includes telescopically interfitting arrangement of an upper mast 40 and a lower slider 42. In the preferred embodiment, mast 40 and slider 42 have generally tubular configurations with slider 42 telescopically interfitting within mast 40. Preferably, slider 42 freely undergoes longitudinal movement within mast 40. As can be seen for example in FIGS. 4–6, spring bands 38 are arranged on either side of mast 40 and slider 42. In the fully closed position illustrated in FIG. 6, bands 38 lie generally parallel to and adjacent mast 40 and slider 42. As can been seen in FIGS. 4–6, spring bands 38 have a band-like flat spring configuration and are preferably rectangular in cross section. The upper ends of bands 38 are pivotally connected to the upper end of mast 40 at pin connections 50. The lower ends of bands 38 are pivotally connected at 52 to slider 42. In the preferred embodiment, the upper ends of panels 12, 14 are secured with a threaded fastener 56 to the upper end of mast 40. By collapsing the spring bands 38, as indicated in FIG. 6, and removing threaded fastener 56, the joined message panels 12, 14 can be conveniently removed from the internal structure of signaling device 10. Preferably, with the use of rivet fasteners 32, the outer periphery of the sign panels 12, 14 are joined together with spacers 22 to form a pocket subassembly. If desired, removable fasteners can be employed to join the outer peripheries of the message panels to allow their separation from one another, although this has not been found necessary or desirable in the preferred embodiment.

Turning now to FIGS. 4–6, operation of the signaling device will be described. In FIGS. 4–6, the signaling device is portrayed in exploded pictorial format for explanatory purposes. In use, the message panels in FIGS. 4–6 are joined together, preferably permanently in the outer periphery and most preferably at the corners of their outer edges. In FIG. 4, the signaling device is shown in a fully opened display position with spring bands 38 fully expanded in an arcuate, generally part circular shape. In the fully expanded configuration, spring bands 38 preferably contact some or all of the spacers 22 so as to exert an outwardly directed force through the spacers and rivet fasteners to the message panels. Accordingly, it is generally preferred that outwardly directed tension forces be applied to the corners of the message panels to maintain the message panels in a taut condition. This arrangement provides the highest performance for the message panels, particularly for message panels made of reflective material, where it is important to maintain the message panels in a flat, generally planar condition to display the clearest message indication.

Figure 8A:
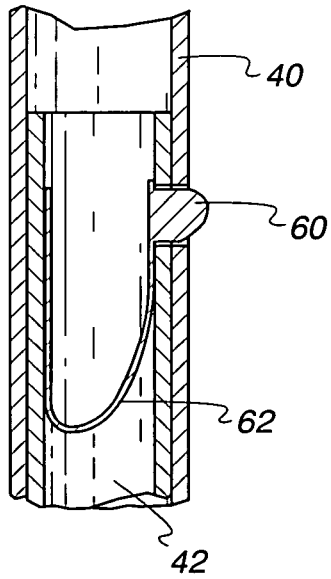
FIG. 8*a* is a cross-sectional view taken along the line 8*a*–8*a* of FIG. 4.

As mentioned, the message panels rely on the multi-point spaced array of outwardly directed tensioning forces imparted to the rollers, rivets and message panels by spring bands 38. These outwardly directed forces are maintained by a preselected amount of telescopic interfitting of slider 42 within mast 40. In the fully-opened position illustrated in FIG. 4, mast 40 and slider 42 are locked together to prevent relative telescopic movement. Virtually any locking arrangement can be employed, although the preferred locking arrangement as illustrated in FIG. 8*a*, includes a ramp button 60 secured to one end of a flat spring 62, held captive within slider 42. An aperture 64 formed in mast 40 (see FIG. 8*b*) allows the ramp button 60 to engage mast 40 in the manner indicated in FIG. 8*a*, thus locking the mast and slider together in fixed position.

Figure 8B:
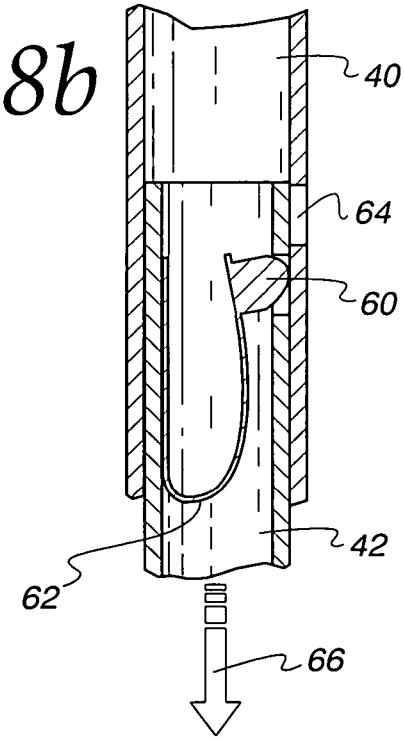
FIG. 8*b* is a cross-sectional view similar to that of FIG. 8*a* showing a subsequent sequence of operation.

By depressing the ramp button in the manner indicated in FIG. 8*b*, slider 42 is allowed downward movement in the direction of arrow 66. Downward movement in the direction of arrow 66 is aided by stored spring force within spring bands 38 which tend to assume the fully-relaxed position illustrated in FIG. 6. FIG. 5 illustrates an intermediate operating position temporarily assumed by the signaling device upon release of ramp button 60 in the manner indicated in FIG. 8*b*. Slider 42 through its pivotal coupling 52 to spring bands 38 experiences a downwardly directed tension force developed by the pivotal fixation of the upper ends of spring bands 38 to the upper end of mast 40, utilizing pivotal connections 50. As illustrated in FIG. 5, outward tension forces are relaxed in all but two of the spacers, located in the lower portion of the signaling device. If left unimpeded, slider 42 continues a downward motion relative to mast 40 with the spring bands 38 assuming a position substantially parallel to and closely spaced about opposing sides of mast 40 and slider 42 (see FIG. 6). When the signaling device 10 is employed with a sign stand base or other mounting for slider 42, the slider will be maintained in a stationary position while mast 40 will be made to travel in an upward direction throughout the sequence of operation explained above with reference to FIGS. 4–6. In either event, with relative telescopic motion of the slider, stored energy in spring bands 38 is relaxed, allowing the spring bands to collapse against or close to mast 40 and slider 42.

In the preferred embodiment, mast 40 and slider 42 are made of relatively rigid material such as aluminum or plastic, although virtually any materials known today can be employed for the purpose. For example, lightweight filled fiberglass composites may offer advantages in certain applications. If desired, mast 40 and slider 42 can exhibit a certain amount of flexibility, provided the relative telescopic movement of the two members is not substantially impaired. As mentioned, it is generally preferred that the mast and slider members have a tubular configuration. Preferably, these members are hollow for weight reduction purposes. If desired, hollow plastic tubing can be employed. For example, mast 40 can be made of 1.5 inch diameter Schedule 40 plastic pipe or the like, if desired. The use of plastic pipe materials is particularly attractive when the signaling device 10 is to be hand held. FIG. 2 shows the signaling device 10 in the fully-collapsed configuration of FIG. 6 with the message panels 12, 14 rolled about the mast and slider to form an elongated generally cylindrical storage package which is favored for its compactness and easy stowability. Thus, the signaling device 10 is particularly suitable for use by emergency or temporary personnel who carry a range of equipment in addition to the signaling device.

Figure 10:
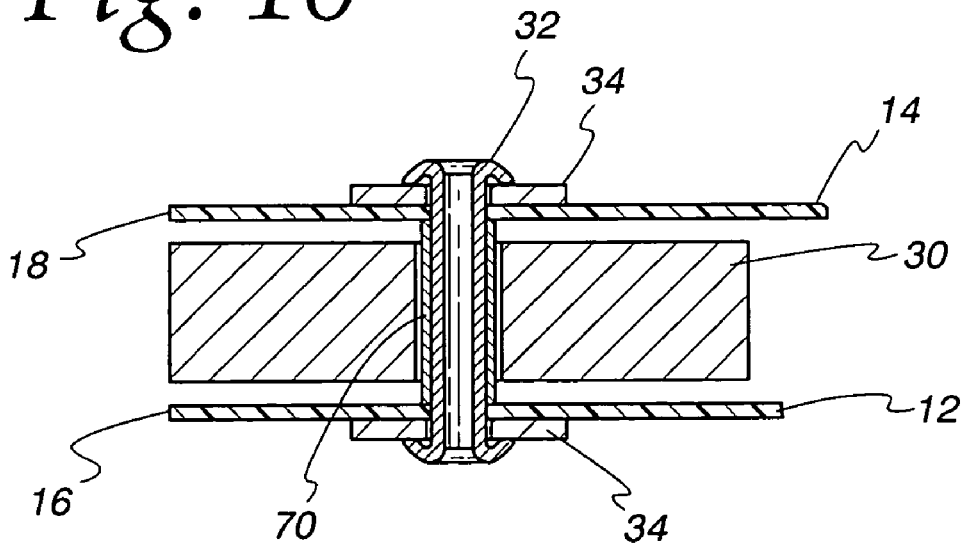
FIG. 10 is a fragmentary cross-sectional view similar to that of FIG. 9, but showing an alternative fastening arrangement.
Figure 11:
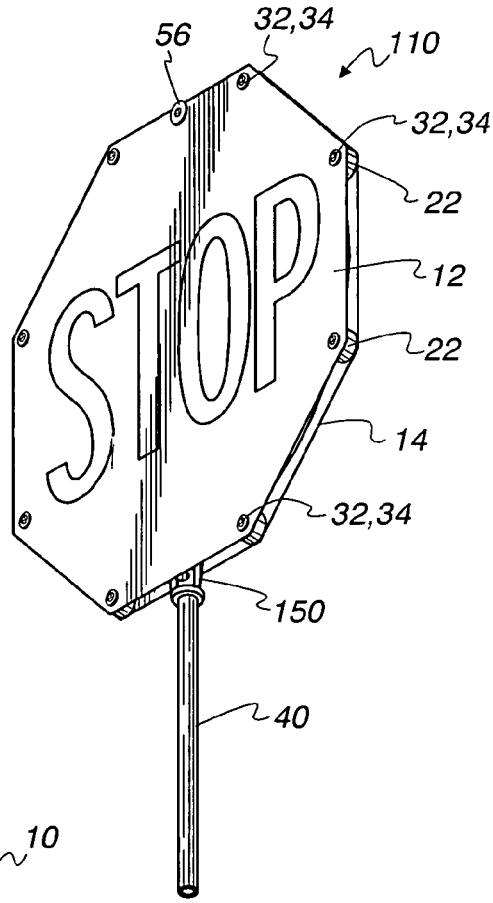
FIG. 11 shows the alternative display device in a fully opened configuration.
Figure 12:
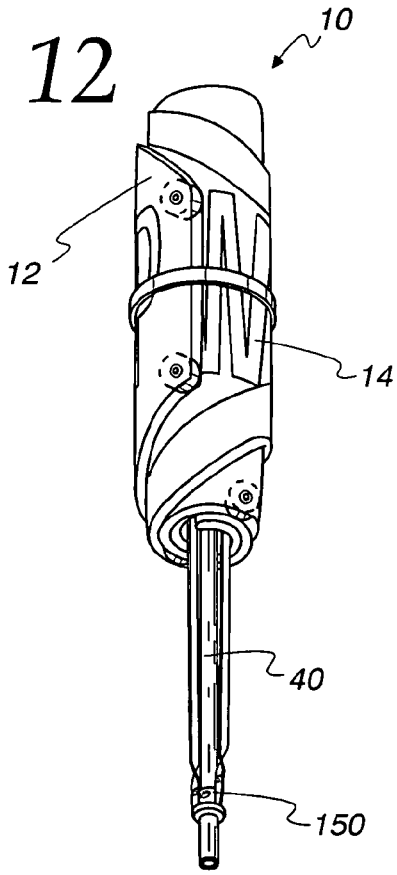
FIG. 12 shows the alternative display device in a fully closed and wrapped configuration.
Figure 13:
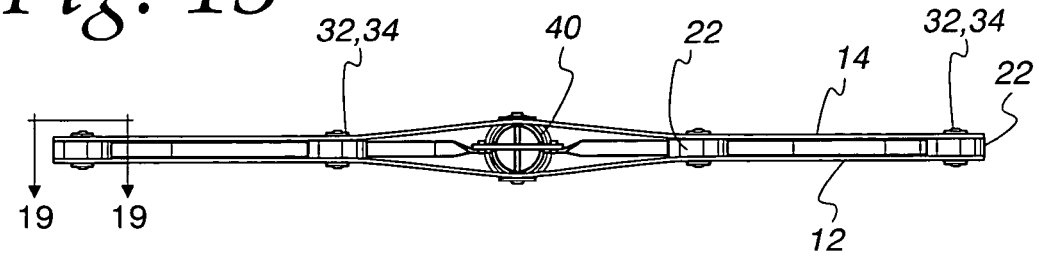
FIG. 13 is a top plan view of the alternative embodiment of FIG. 11.

Turning now to FIG. 10, an alternative construction similar to that of FIG. 9 is shown. In FIG. 9, the cylindrical spacer 30 is fixedly secured to message panels 12, 14 by rivet fastener 32. In FIG. 10, an internal spacer 70 is employed to provide spacer 30 a rotational mounting, allowing spacer 30 to freely rotate about rivet fastener 32. This arrangement reduces wear on the outer surfaces of the spacers arising from contact with spring bands 38 and assures a reliable, positive displacement of the spring bands when multiple points of contact are simultaneously established in the manner indicated in FIG. 4.

Turning now to FIGS. 11–20, an alternative signaling device is indicated at 110. As will be seen herein, signaling device 110 includes many of the same components as described above with reference to signaling device 10. For example, signaling device 110 includes opposed message panels 12, 14 joined together to form a pocket assembly, using spacers 22 and rivet fasteners and washers 32, 34. In the preceding embodiment, mast 40 of signaling device 10 has a length corresponding generally to the height of the message panels, as can be seen for example in FIG. 4. In signaling device 110, mast 40 is substantially longer, extending well beyond the message panel as can be seen for example in FIG. 16. In message panel 110, the upper ends of spring bands 38 are attached to the upper end of mast 40 as in the preceding embodiment. However; the lower ends of spring bands 38 are attached to a sliding collar 150 which has an internal bore dimensioned for sliding reception of mast 40, as illustrated for example in FIG. 18*a*. As can be seen in FIG. 18*b*, sliding collar 150 includes an aperture 152 dimensioned to receive ramp button 60, in the manner indicated in FIG. 18*a* showing the sliding collar 150 and mast 40 locked together.

Figure 14:
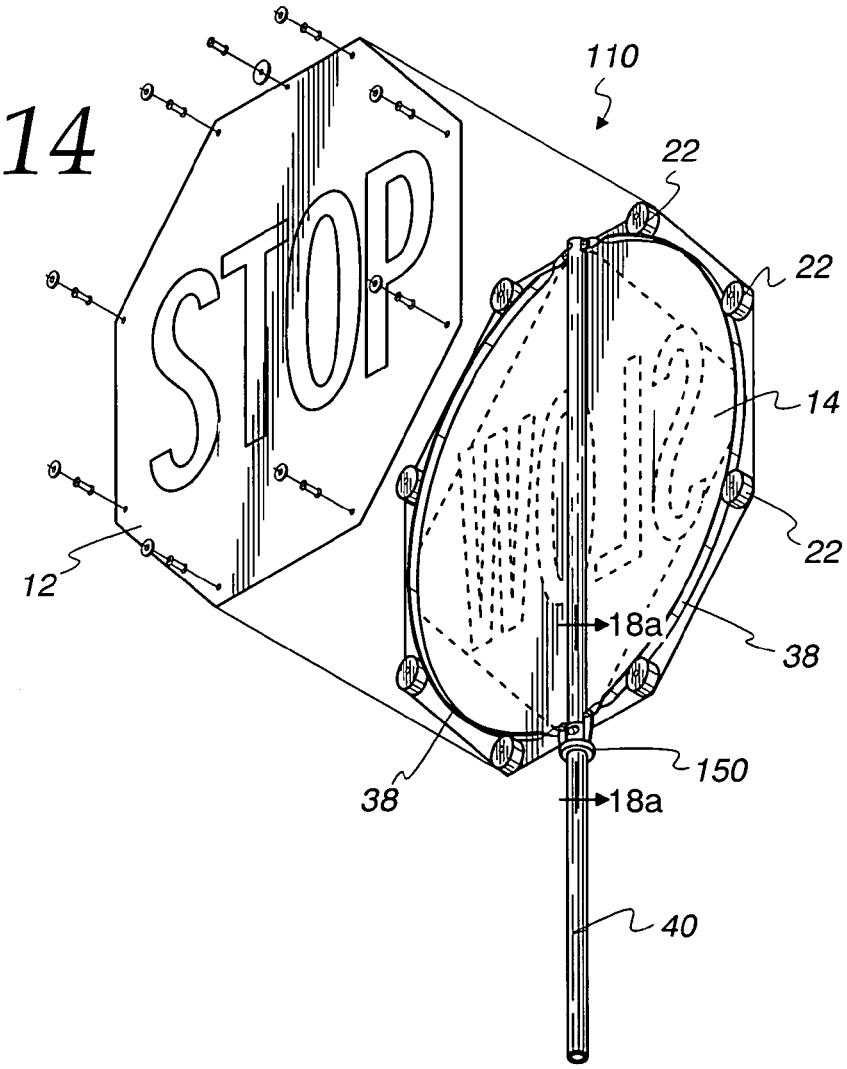
FIG. 14 shows the internal structure of the alternative signaling device in a fully opened configuration.
Figure 15:
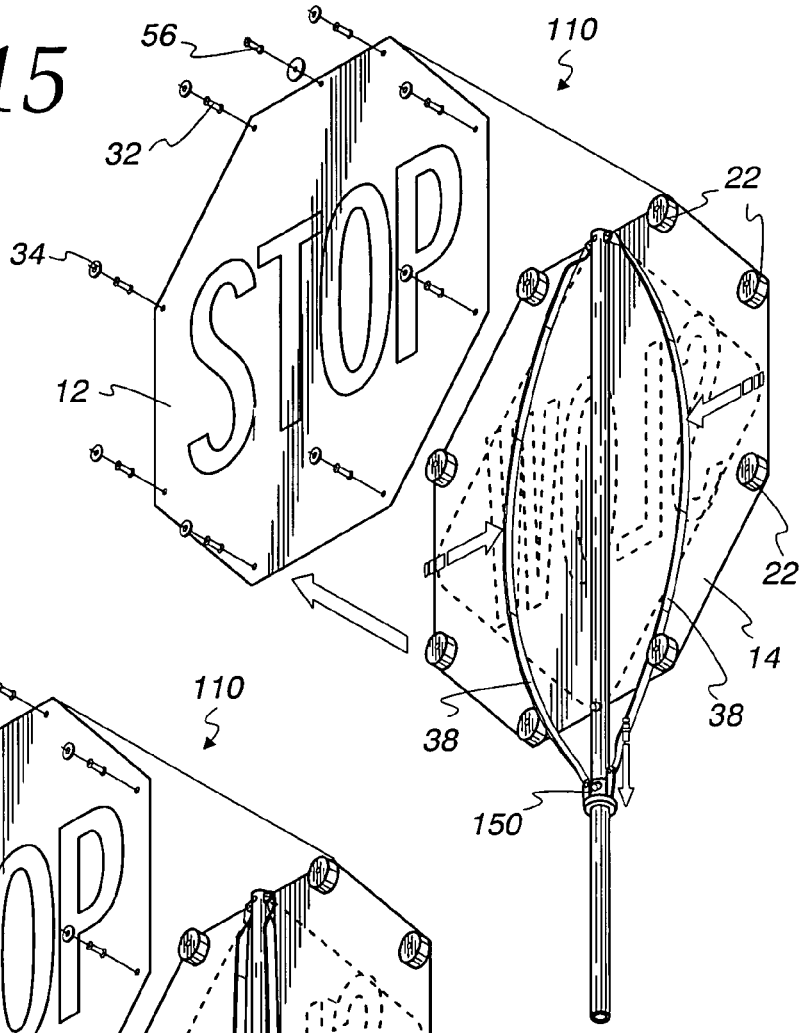
FIG. 15 shows the internal structure of the alternative signaling device in an intermediate, partially open configuration.
Figure 16:
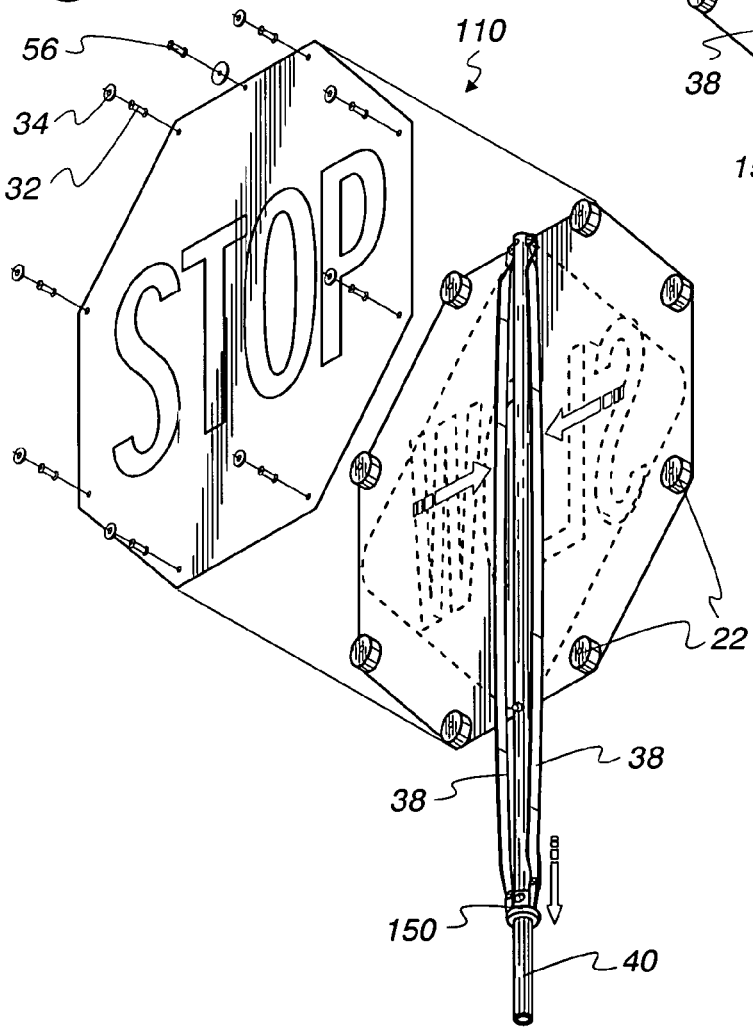
FIG. 16 shows the internal structure of the alternative signaling device in a fully closed configuration.
Figure 17:
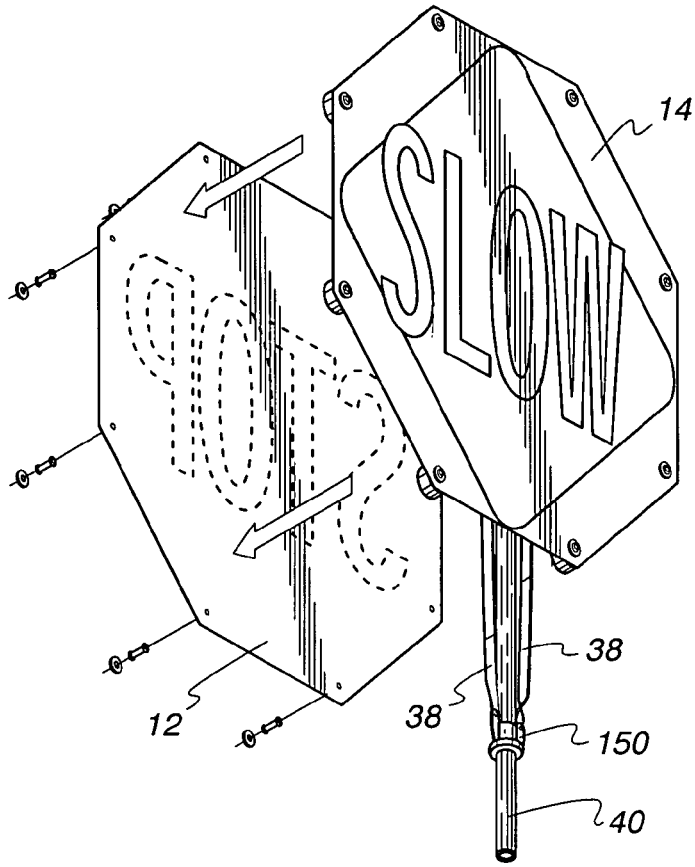
FIG. 17 is a rear elevational view of the alternative signaling device.
Figure 18A:
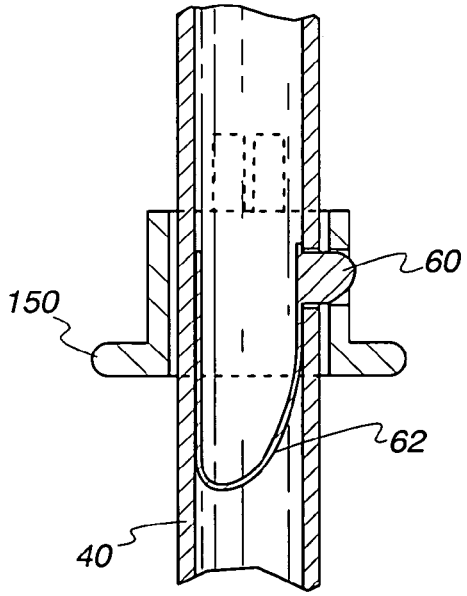
FIG. 18 is a cross-sectional view taken along the line 18*a*–18*a* of FIG. 14.
FIG. 18*b* is a cross-sectional view similar to that of FIG. 18*a* showing a subsequent sequence of operation.
Figure 18B:
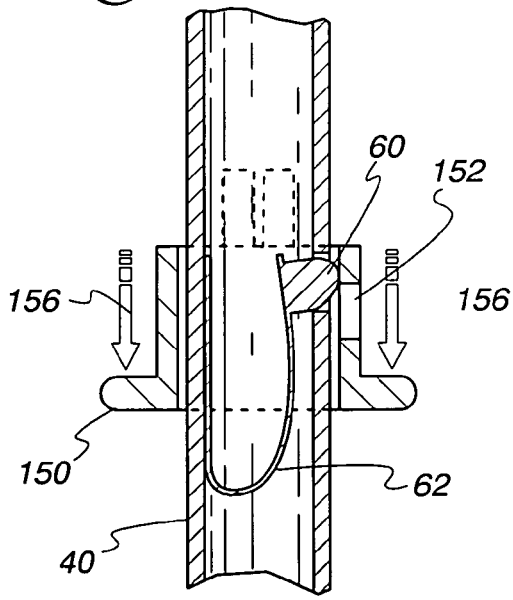
Figure 19:
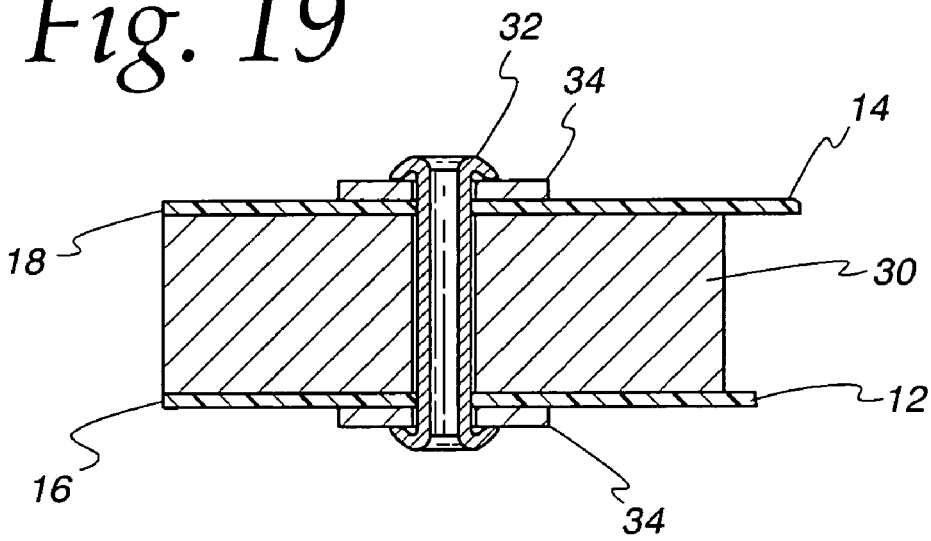
FIG. 19 is a fragmentary cross-sectional view taken along the line 19–19 of FIG. 13.
Figure 20:
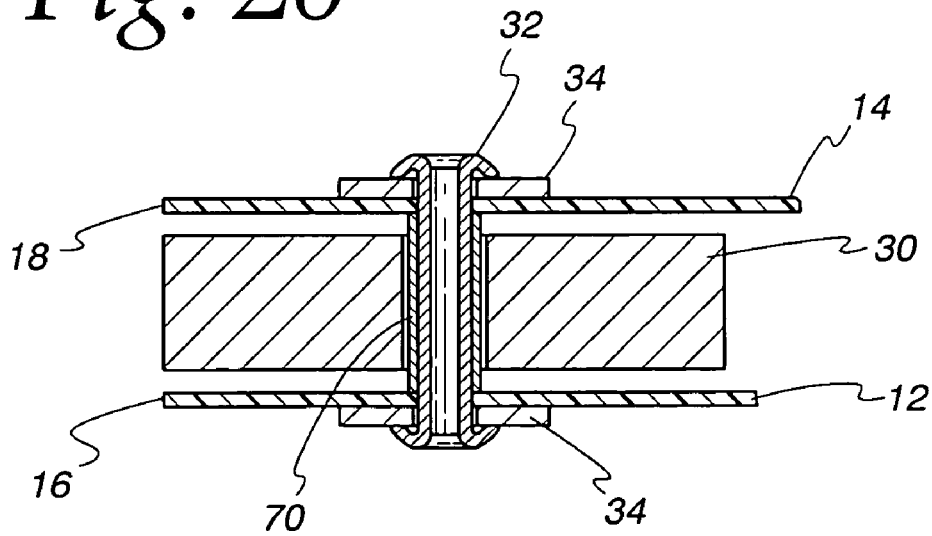
FIG. 20 is a fragmentary cross-sectional view similar to that of FIG. 19 but showing an alternative fastening arrangement

Operation of the signaling device 110 is the same as that described above with respect to signaling device 10. With reference to FIGS. 14-16, signaling device 110 is initially shown in a fully-opened display configuration, with collar 150 locked to mast 40 in the manner indicated in FIG. 18*a*. By depressing ramp button 60, collar 150 is allowed to slide in a downward direction of arrows 156, as illustrated in FIG. 18*b*. Signaling device 110 is then allowed to take on the temporary intermediate configuration illustrated in FIG. 15, with spring bands 38 partially collapsed, bearing only against the lowermost pair of spacers 22. The stored energy in spring bands 38 biases slider collar 150 for further sliding displacement until the spring bands 38 are relaxed in the manner indicated in FIG. 16. In the preferred embodiment, sliding collar 150 is made of a plastic material while mast 40 comprises a hollow aluminum tube.

Referring now to FIGS. 21–32 alternative embodiments of signaling devices according to principles of the present invention are shown. In summary, the signaling devices shown FIGS. 21–32 resemble the signaling devices shown above, except that the flat metal springs have been replaced with non metallic spring elements. Preferably, the spring elements of FIGS. 21–32 comprise plastic-like materials exhibiting an ability to store a spring force when deflected from a rest position. Most preferably, the spring elements of FIGS. 21–32 comprise conventional fiberglass rounds and ribs.

Figure 21:
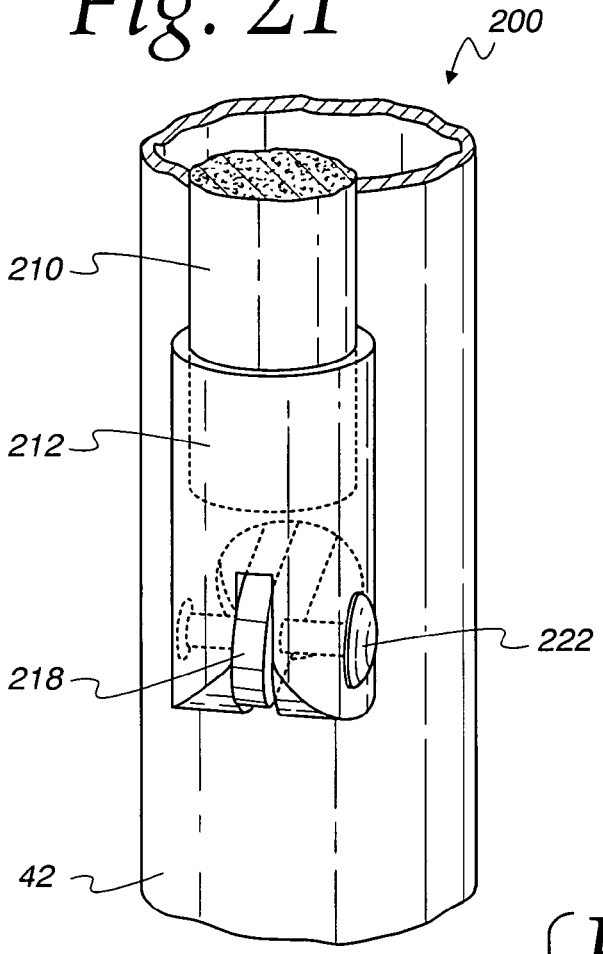
FIG. 21 is a fragmentary perspective view showing an alternative embodiment of a signaling device according to principles of the present invention.
Figure 22:
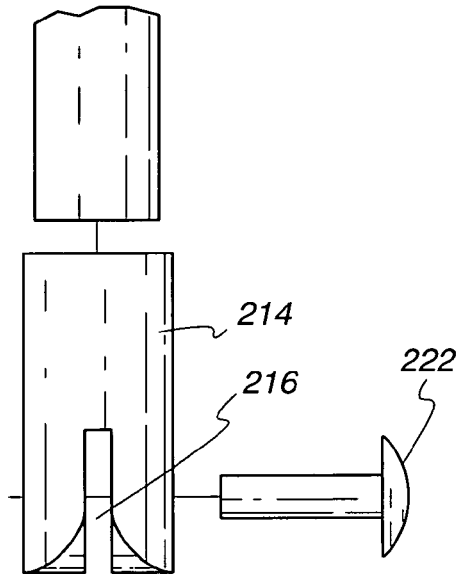
FIG. 22 is a front elevational view thereof.
Figure 23:
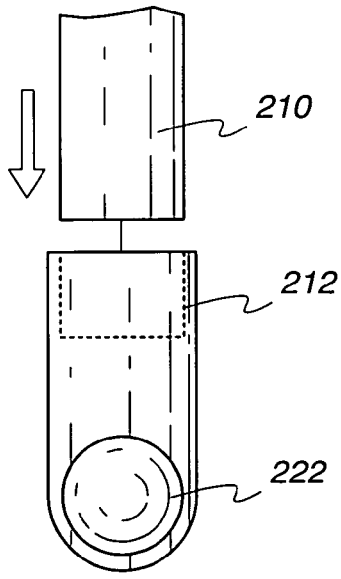
FIG. 23 is a side elevational view thereof.

Referring now to FIGS. 21–23, signaling device 200 is substantially identical to signaling device 10 shown above in FIGS. 1–10, except that the flat springs or spring bands 38 are replaced by a non metallic, preferably fiberglass rod 210. Preferably, rod 210 has the same overall length and bending force as spring bands 38. Whereas the spring bands 38 are conventionally prepared for attachment using metal forming techniques, the fiberglass rods 210 require a mounting bracket 212 preferably made of molded plastic material. Bracket 212 includes a cylindrical recess to receive the free end of fiberglass 210, as illustrated in FIG. 21. The remaining bottom end of bracket 212 includes a clevis portion 214 defining a slot 216 for receiving an ear 218 constructed from or otherwise joined to slider 42. A rivet connection 222 secures the mounted bracket to slider 42. If desired, the fiberglass rod 210 can be secured to mounting bracket 212 with an epoxy resin or other adhesive.

Figure 24:
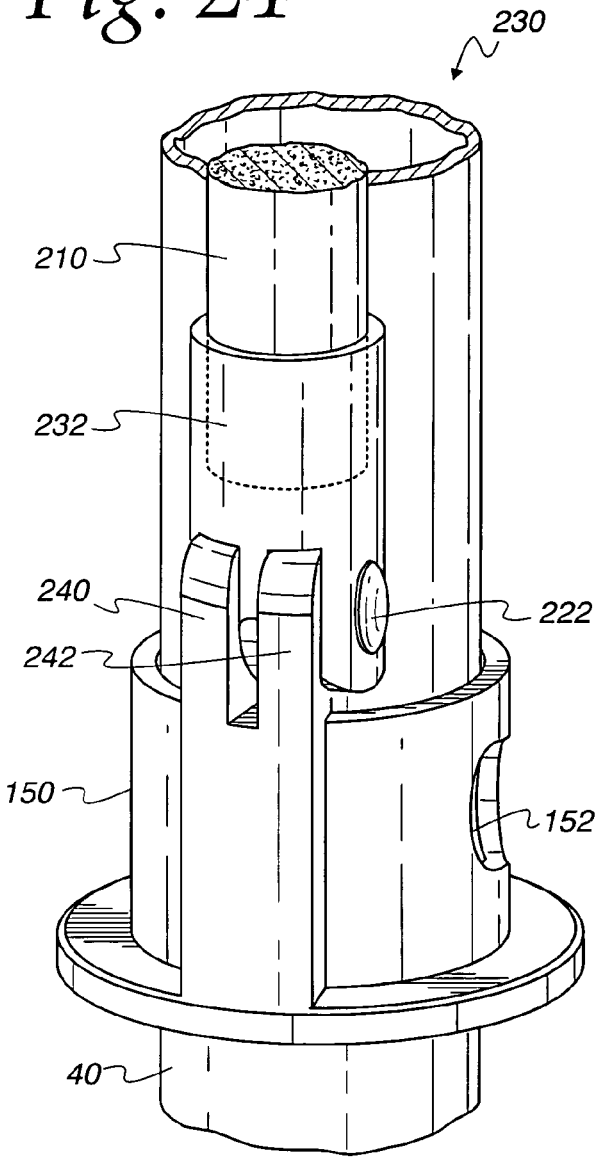
FIG. 24 is a fragmentary perspective view of a further embodiment of signaling device according of principles of the present invention.
Figure 25:
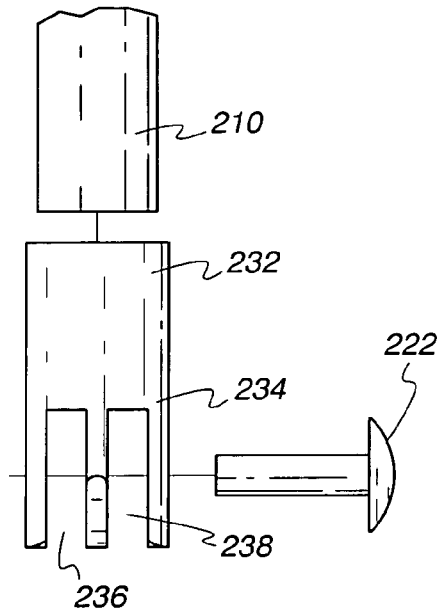
FIG. 25 is a front elevational view thereof.
Figure 26:
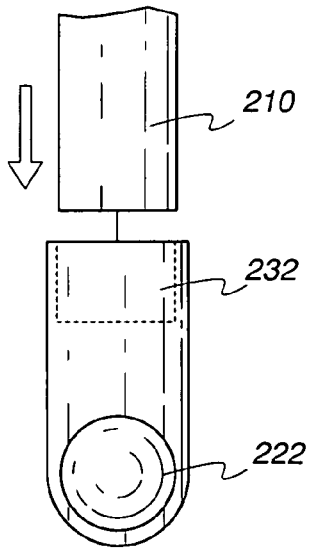
FIG. 26 is a side elevational view thereof.

Turning now to FIGS. 24–26, signaling device 230 generally resembles signaling device 110 described above with reference to FIGS. 11–20, but with the spring band 38 replaced with a non metallic spring element 210, preferably of fiberglass construction. Signaling device 230 includes a mounting bracket 232 having a first end defining a recess for receiving the free end of fiberglass rod 210 and a second end 234 defining slots 236, 238 for receiving the mounting ears 240, 242 of sliding collar 150. Except for the addition of mounted ears 240, 242, sliding collar 150 of FIG. 24 is substantially identical to the collar of FIGS. 18*a*, 18*b* for example. A line 152 is provided, as shown in FIG. 24, by receiving the button protrusion 60 shown in FIGS. 18*a*, 18*b*.

Figure 27:
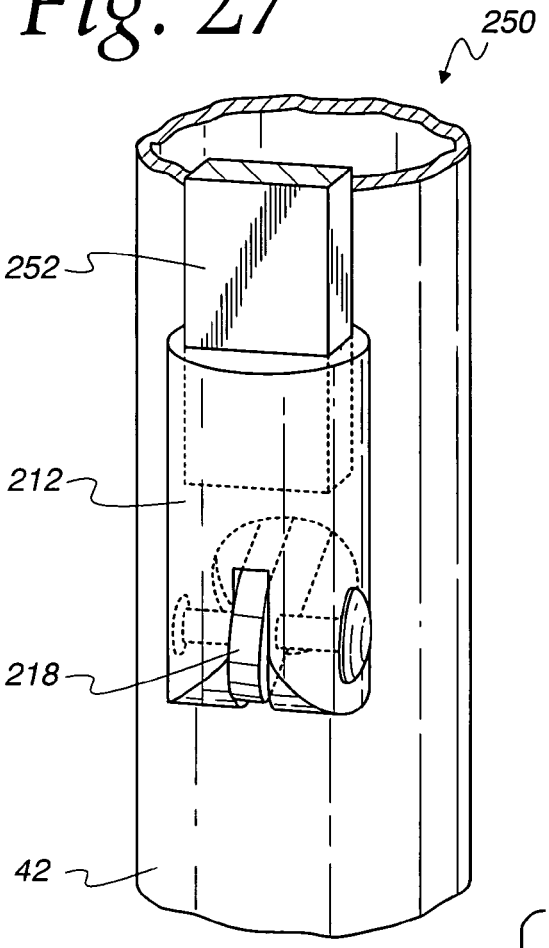
FIG. 27 is a fragmentary perspective view of another embodiment of signaling device according principles of the present invention.
Figure 28:
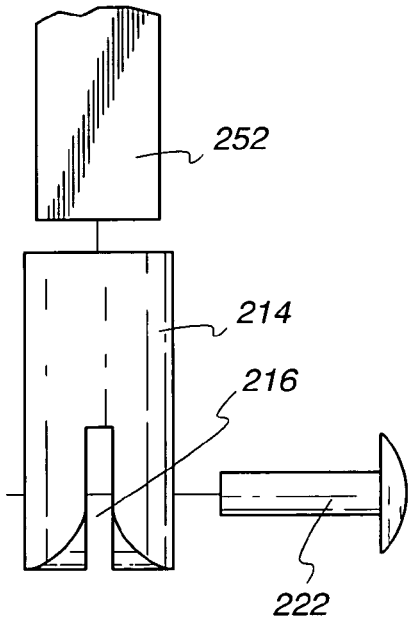
FIG. 28 is a front elevational view thereof.
Figure 29:
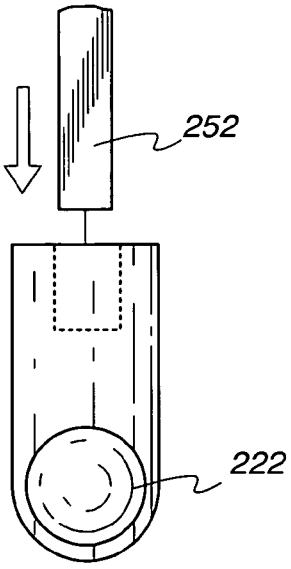
FIG. 29 is a side elevational view thereof.

Turning now to FIGS. 27–29 a signaling device 250 is substantially identical to the signaling device 230 described above with reference to FIGS. 24–26, except that the cylindrical non metallic spring element 210 is replaced by a non metallic spring element 252 having a bar shape with an elongated rectangular cross section.

Figure 30:
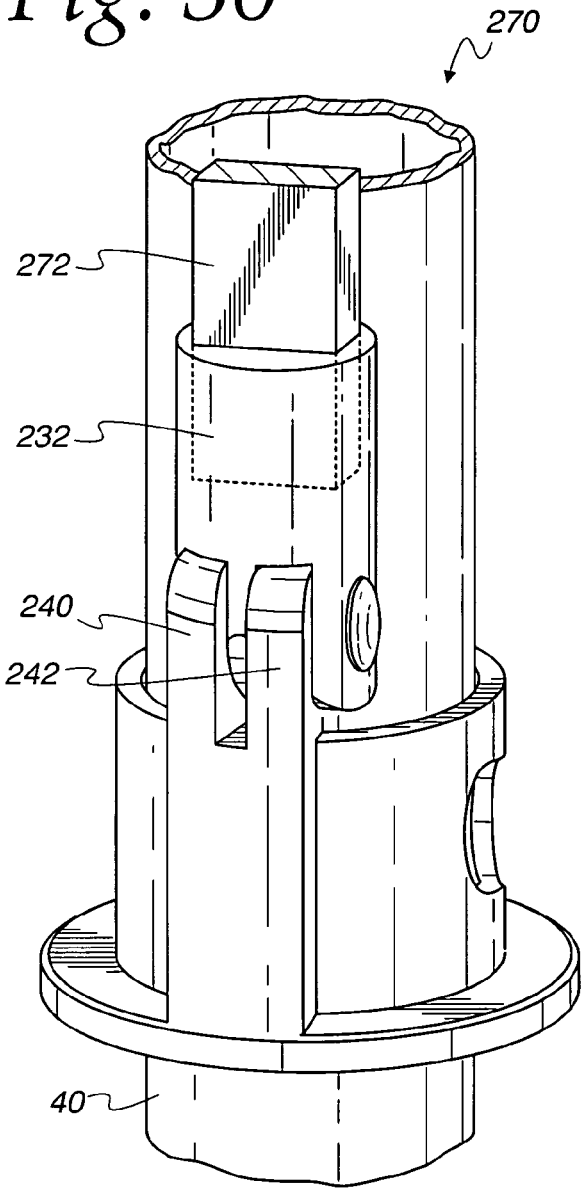
FIG. 30 is another fragmentary perspective view of signaling device according to principles of the present invention.
Figure 31:
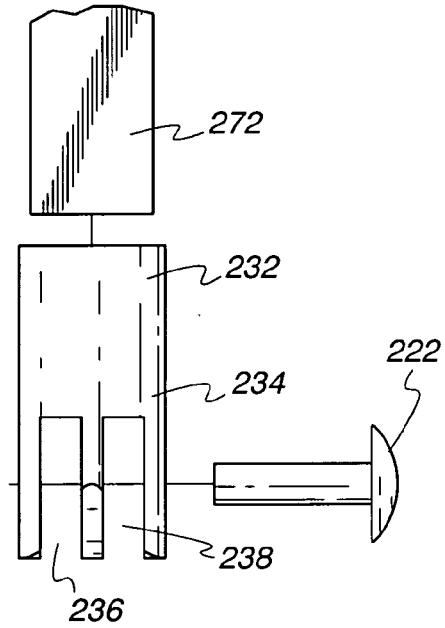
FIG. 31 is a front elevational view thereof.
Figure 32:
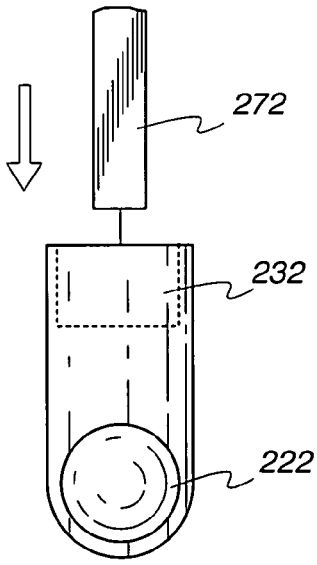
FIG. 32 is a side elevational view thereof.

Referring to FIGS. 30–32, signaling device 270 is substantially identical to signaling device 230 described above with reference to FIGS. 24–26, except that the cylindrical non metallic spring element 210 is replaced with a non metallic spring element 272 having a bar shape with a generally rectangular cross section. Preferably, the spring element 272 is of conventional fiberglass ribbed construction, as is the spring element 252 show in FIG. 27.

Operation of the signaling devices shown in FIGS. 21–32 is substantially identical to operation of signaling devices shown in the proceeding FIGS. 1–20. If different spring characteristics are desired, the non metallic spring elements of FIGS. 21–32 can be replaced with conventional non metallic spring elements.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A collapsible signaling device, comprising:

a pocket member comprising a pair of overlying panels of flexible material, each having an outer periphery;

a plurality of spacers at a plurality of points about the outer periphery of said panels;

fasteners at said plurality of points joining said panels;

an internal structure comprising an elongated mast having an upper portion;

a slider member slidably movable with respect to said mast;

a pair of struts of spring material having first ends attached to the upper portion of said mast and second ends attached to said slider member;

said pocket member covering at least a portion of said struts; and said struts, said mast and said slider member cooperating to cause said struts to bow out and contact at least some of said spacers when said slider member is at a first position relative to said mast and to cause said struts to generally lie along said mast when said slider member is at a second position relative to said mast.

2. The device of claim 1 wherein said slider member comprises a collar slidably mounted about said mast.

3. The device of claim 1 wherein said mast is hollow and said slider member comprises a tube telescopically movable within said mast.

4. The device of claim 1 wherein said struts comprise elongated flat bars of spring material.

5. The device of claim 1 wherein said panels have a generally octagonal shape and said points are located at corners of said octagonal shape.

6. The device of claim 1 further comprising a lock member releasably locking said mast and said slider member.

7. The device of claim 1 wherein the first and the second ends of said struts are pivotally mounted to said mast and to said slider member, respectively.

8. The device of claim 1 wherein said panels are made of flexible reflective sign material.

9. The device of claim 1 wherein, with said slider member at the second position relative to said mast, said panels are wrapped about said struts and said mast.

10. A collapsible signaling device, comprising: a pocket member comprising a pair of overlying panels of flexible material, each having an outer periphery;

a plurality of spacers at a plurality of points about the outer periphery of said panels;

fasteners at said plurality of points joining said panels;

an internal structure comprising an elongated mast having an upper portion;

a collar slidably movable along said mast;

a pair of struts of spring material having first ends attached to the upper portion of said mast and second ends attached to said collar;

said pocket member covering at least a portion of said struts; and said struts, said mast and said collar cooperating to cause said struts to bow out and contact at least some of said spacers when said collar is at a first position relative to said mast and to cause said struts to generally lie along said mast when said collar is at a second position relative to said mast.

11. A display device, comprising: a pair of overlying flexible panels having marginal edges joined together to form a pouch defining an interior cavity with an opening communicating with the interior cavity, with at least one of said panels displaying a message;

an internal frame at least partly inserted through said opening so as to lie within said interior cavity;

said internal frame including a mast and a pair of generally coextensive double ended resilient ribs having first ends pivotally joined to said mast;

a slider member slidably engaging said mast, with second ends of said ribs pivotally joined to said slider member; and said ribs, said mast and said slider member cooperating so that with said slider member advanced toward the a free end of said mast, said ribs are compressed to take on a generally arcuate shape within said pouch.

12. The display device of claim 11 wherein the mast comprises a hollow cylindrical tube and said ribs are joined to diametrically opposed portions of said tube.

13. The display device of claim 11 wherein the ribs have a generally part circular shape when compressed within said pouch.

14. The display device of claim 11 wherein both panels display a message.

15. The display device of claim 14 wherein the messages on said panels are different.

16. The display device of claim 11 further comprising a plurality of spacers used to join the marginal edges of said flexible panels together.

17. The display device of claim 16 wherein the spacers are hollow and said display device further includes a plurality of fastener members, said spacers joining portions of said panels together.

18. The display device of claim 17 wherein the fasteners comprise rivets.

19. The display device of claim 16 wherein the spacers comprise hollow sleeves with rollers rotatingly mounted about said sleeves.

20. The display device of claim 16 wherein the ribs contact at least some of said spacers when said ribs are compressed to take on a generally arcuate shape within said pouch.

21. The display device of claim 11 wherein the slider comprises a collar slidable along said mast.

22. The display device of claim 11 wherein the slider comprises a tube telescopically movable with respect to said mast.

23. The display device of claim 11 wherein the mast is hollow and said slider is tube telescopically movable within said mast.

24. The display device of claim 11 wherein said panels are light reflecting fabric.

25. The display device of claim 11 further comprising a fastener member joining portions of said panels to said mast, adjacent the mast free end.

26. The display device of claim 11 wherein the mast comprises a hollow aluminum tube.

27. The display device of claim 11 wherein the ribs comprise spring steel bands.

* * * * *